US010072496B2

(12) United States Patent
Nitsche et al.

(10) Patent No.: US 10,072,496 B2
(45) Date of Patent: Sep. 11, 2018

(54) TELEMETRY SYSTEM WITH TERAHERTZ FREQUENCY MULTIPLIER

(71) Applicant: Halliburton Energy Services, Inc., Houston, TX (US)

(72) Inventors: Wolfgang Hartmut Nitsche, Humble, TX (US); John L. Maida, Houston, TX (US); Satyan Gopal Bhongale, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 57 days.

(21) Appl. No.: 15/320,675

(22) PCT Filed: Jul. 7, 2015

(86) PCT No.: PCT/US2015/039335

§ 371 (c)(1),
(2) Date: Dec. 20, 2016

(87) PCT Pub. No.: WO2017/007453

PCT Pub. Date: Jan. 12, 2017

(65) Prior Publication Data

US 2017/0198568 A1 Jul. 13, 2017

(51) Int. Cl.
*E21B 47/12* (2012.01)

(52) U.S. Cl.
CPC ..... *E21B 47/122* (2013.01)

(58) Field of Classification Search
CPC ..... E21B 47/122
USPC ..... 340/854.4, 854.6
See application file for complete search history.

(56) References Cited

U.S. PATENT DOCUMENTS

| | | | | |
|---|---|---|---|---|
| 3,905,010 | A | 9/1975 | Fitzpatrick | |
| 5,831,549 | A | 11/1998 | Gearhart | |
| 6,727,827 | B1 | 4/2004 | Edwards et al. | |
| 7,835,226 | B2 * | 11/2010 | Kokosalakis | H04B 13/00 340/854.4 |
| 8,390,471 | B2 * | 3/2013 | Coates | E21B 47/122 250/261 |
| 2003/0006906 | A1 | 1/2003 | Gardner et al. | |
| 2005/0024231 | A1 * | 2/2005 | Fincher | E21B 17/028 340/854.4 |

(Continued)

FOREIGN PATENT DOCUMENTS

WO 2011066624 A1 6/2011

OTHER PUBLICATIONS

Abele, Thomas A., D. A. Alsberg, and P. T. Hutchison. "A high-capacity digital communication system using TE 01 transmission in circular waveguide." IEEE Transactions on Microwave Theory and Techniques 23.4 (1975): 326-333.

(Continued)

*Primary Examiner* — Albert K Wong
(74) *Attorney, Agent, or Firm* — John Wustenberg; Baker Botts L.L.P.

(57) ABSTRACT

An example telemetry system for downhole operations in a subterranean formation comprises an electromagnetic (EM) radiation source and an EM radiation detector. A waveguide may be coupled to the EM radiation source and the EM radiation detector. A frequency multiplier may be coupled to the waveguide and positioned within a borehole in the subterranean formation.

19 Claims, 4 Drawing Sheets

(56) References Cited

U.S. PATENT DOCUMENTS

| | | | | |
|---|---|---|---|---|
| 2005/0136861 | A1* | 6/2005 | Sorrells | H03C 1/62 455/118 |
| 2005/0184880 | A1* | 8/2005 | Gao | G01V 11/002 340/854.4 |
| 2005/0190373 | A1 | 9/2005 | Pepper et al. | |
| 2010/0073110 | A1* | 3/2010 | Nathan | B82Y 20/00 333/218 |
| 2011/0018734 | A1 | 1/2011 | Varveropoulos et al. | |
| 2017/0155531 | A1* | 6/2017 | Kawasaki | H04L 27/04 |

OTHER PUBLICATIONS

International Search Report and Written Opinion in related Application No. PCT/US2015/039335, dated Nov. 16, 2015 (15 pages).

* cited by examiner

TELEMETRY SYSTEM WITH TERAHERTZ FREQUENCY MULTIPLIER

CROSS-REFERENCE TO RELATED APPLICATION

The present application is a U.S. National Stage Application of International Application No. PCT/US2015/039335 filed Jul. 7, 2015, which is incorporated herein by reference in its entirety for all purposes.

BACKGROUND

The present disclosure relates generally to well drilling and completion operations and, more particularly, to a telemetry system with a terahertz frequency multiplier.

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

Certain drilling systems include measurement and logging devices that generate data and information downhole. This data and information may, for instance, relate to the physical condition of the drilling system and the characteristics of the subterranean formation surrounding the wellbore. Telemetry systems may transmit the data and information from the downhole measurement and logging devices to information handling systems positioned at the surface and/or receive data and information from the information handling systems. The total time it takes to communicate data and information to and from the surface may affect the drilling system's ability to implement real-time or near real-time computations or commands. That time may be affected by the transmission speed of the telemetry system as well as the data bandwidth afforded by the transmission medium. Implementing high-speed/high-bandwidth communications through a telemetry system can be difficult due to technical limitations as well as the additional expense such systems may require.

FIGURES

Some specific exemplary embodiments of the disclosure may be understood by referring, in part, to the following description and the accompanying drawings.

Figure 1:
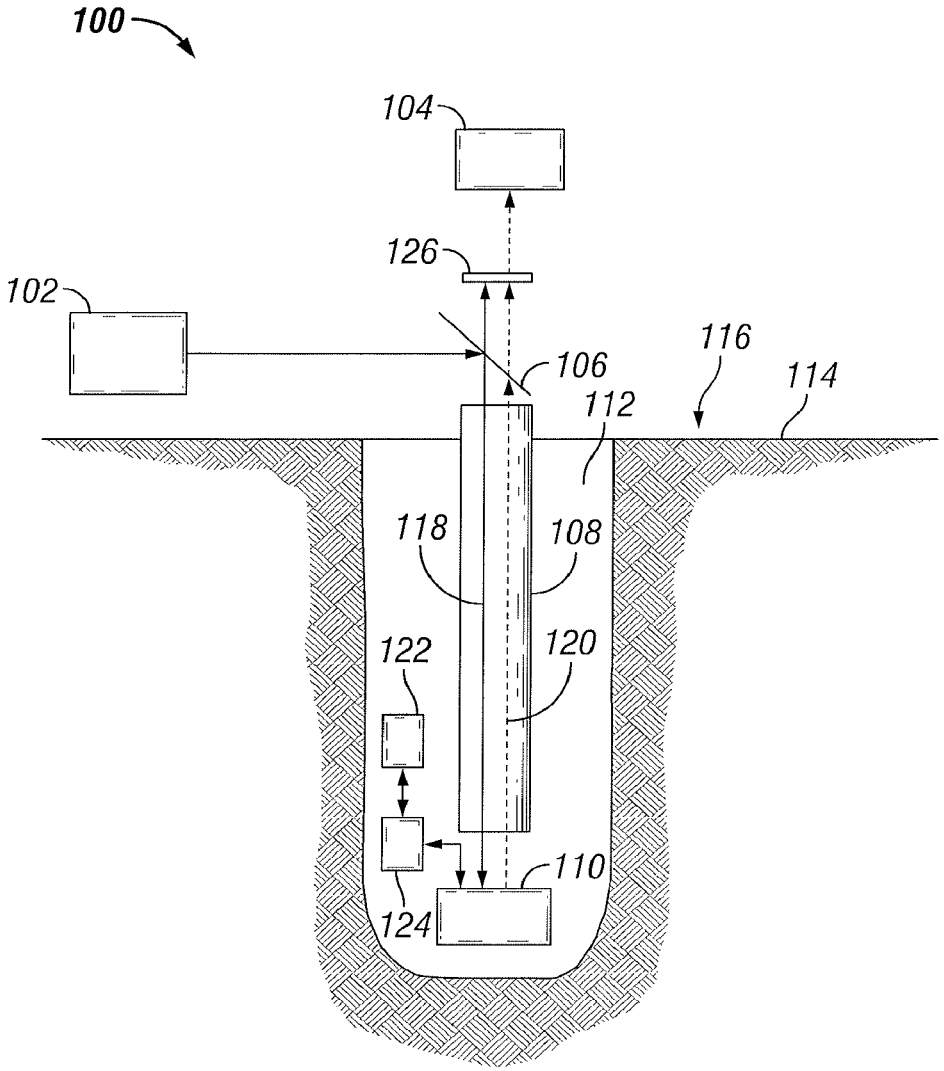
FIG. 1 is a diagram illustrating an example telemetry system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing. Any one of the computer readable media mentioned above may stored a set of instruction that, when executed by a processor communicably coupled to the media, cause the processor to perform certain steps of actions.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to drilling operations that include, but are not limited to, target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, stimulation wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

Modern petroleum drilling and production operations demand information relating to downhole parameters and conditions. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing downtime. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Thus, if a first device communicatively couples to a second device, that connection may be through a direct connection, or through an indirect communication connection via other devices and connections. The indefinite articles "a" or "an," as used herein, are defined herein to mean one or more than one of the elements that it introduces. The term "uphole" as used herein means along the drillstring or the hole from the distal end towards the surface, and "downhole" as used herein means along the drillstring or the hole from the surface towards the distal end.

According to aspects of the present disclosure, a high-speed and high-bandwidth telemetry system may include a high-frequency electromagnetic (EM) radiation source, an EM radiation detector, and a frequency multiplier. The frequency multiplier may be positioned downhole and receive EM radiation from the source through a waveguide, then modify the frequency response of the EM radiation and transmit the modified EM radiation to the detector through the waveguide. The use of a single waveguide may reduce the overall expense of the telemetry system compared to a system with separate waveguides for transmitting and receiving. Additionally, modifying the frequency response of the EM radiation may reduce the interference and noise imparted on the EM radiation received at the detector. The system may also modulate the radiation, for instance, by switching the frequency multiplier on/off or coupling a separate modulator to the waveguide.

FIG. 1 is a diagram illustrating an example telemetry system 100, according to aspects of the present disclosure. The system 100 comprises an EM radiation source 102 and an EM radiation detector 104 coupled to a beam splitter 106. The beam splitter 106 is further coupled to one end of a waveguide 108. A frequency multiplier 110 is coupled to another end of the waveguide 108. As depicted, the frequency multiplier 110 and at least a portion of the waveguide 108 are positioned within a borehole 112 in a subterranean formation 114; and the EM radiation source 102, EM radiation detector 104, and beam splitter 106 are positioned at or above a surface 116 of the formation 114. Different positions, orientations, and combinations of the EM radiation source 102, EM radiation detector 104, beam splitter 106, waveguide 108, and frequency multiplier 110 are possible within the scope of this disclosure. For instance, the EM radiation detector 104 may be in a different orientation than depicted with respect to the formation 114, such as at or below the surface 116. The borehole 112 may have been created or is in the process of being created by a drilling system (not shown) into which the telemetry system 100 is incorporated. The telemetry system 100 may also be incorporated into wireline logging or measurement operations that occur when a drilling system is removed from the borehole 112, as will be described in greater detail below.

The EM radiation source 102 may comprise a high-frequency EM radiation source that is capable of generating quasi-optical EM radiation. As used herein, quasi-optical EM radiation may comprise EM radiation with a frequency from about 30 gigahertz (GHz) to about 10 terahertz (THz). The 30 GHz to 10 THz frequency hand may include both millimeter waves, with frequencies between about 30 GHz to about 300 GHz, and terahertz waves, with frequencies between about 100 GHz to about 10 THz. Example EM radiation sources capable of generating quasi-optical EM radiation include, but are not limited to, free electron lasers, photoconductive dipole antennae, semiconductor THz lasers, cold plasma emitters, electronic emitters, and electro-optic materials excited by femtosecond lasers.

The EM radiation detector 104 may comprise a high-frequency EM radiation detector that is capable of detecting quasi-optical EM radiation. Example EM radiation sources capable of detecting quasi-optical EM radiation include, but are not limited to, photo-diodes, compact electronic detectors, photoconductive dipoles and arrays, electro-optical crystals with femtosecond lasers, bolometers, and pyroelectric detectors.

The beam splitter 106 may comprise a polarizing beam splitter or a non-polarizing beam splitter. A non-polarizing beam splitter may be cheaper to implement, but reduces the power associated with the EM radiation each time that radiation travels through or is reflected by the beam splitter. A polarizing beam splitter may maintain or reduce the power losses associated with the beam splitter. The beam splitter may comprise different frequency-dependent reflectivity values. This may be used, for instance, when the EM radiation transmitted from the source 102 has a different frequency than the EM radiation emitted from the frequency multiplier 110 and received by the detector 104. The beam splitter 106 may be optional. For instance, a waveguide splitter could be used instead of the beam splitter 106, or a horn could be attached to the upper end of the waveguide 108 with the source 102 and detector 104 positioned above it so that the radiation travels through a few centimeters of free space.

The waveguide 108 may comprise a conduit through which the quasi-optical EM radiation generated by the source 102 and emitted by the multiplier 110 may travel. As depicted, the waveguide 108 comprises an elongated tube with a circular cross-section that extends into the borehole 112. The waveguide 108 is not limited to a circular cross section; other example cross-sections include, but are not limited to, square, rectangular, elliptical, and other shapes. The waveguide 108 can also comprise multiple waveguide segments that are joined together at joints to form the waveguide 108. For instance, as will be described in detail below, a drilling system may comprise drill pipe segments that are joined together during a drilling operation, and the waveguide 108 may comprise segments that are attached or otherwise coupled to the drill pipe segments and are connected together when the drill pipe segments are joined. The waveguide 108 or waveguide segments may be made from metal or other resilient non-metal materials capable of withstanding harsh downhole conditions, which may be useful when the telemetry system 100 is incorporated into a drilling assembly. An example metal from which to make the waveguide includes, but is not limited to, gold coated steel. The waveguide 108 may be hollow, partially filled, or filled, such as with a dielectric material that may facilitate transmission of EM radiation. The size of the waveguide 108 may depend, in part, on the wavelength/frequency of the EM radiation to be transmitted therein. For instance, the waveguide 108 may comprise an inner radius of about five or less millimeters for transmission of quasi-optical EM radiation.

The frequency multiplier 110 may comprise a circuit or device that receives an input signal with a first frequency and generates an output signal with a second frequency that is a harmonic multiple of the first frequency. In other words, the second frequency may be two or more times the first frequency. The frequency multiplier 110 may comprise an active or passive frequency multiplier. In the case of an active frequency multiplier, the power of the output signal (having the second frequency) may depend on an applied supply voltage. Passive frequency multipliers may modify the frequency of the received EM radiation without any connected or supplied voltage. Example frequency multipliers include, but are not limited to, a non-linear material on top of a mirror, or a diode circuit.

In use, the EM radiation source 102 may generate and transmit EM radiation 118 to the beam splitter 106, which may reflect the EM radiation 118 into the waveguide 108 toward the frequency multiplier 110. In certain embodiments, an additional device may be included between the source 102 and the waveguide 108 to manipulate the radiation coming from the source 102 in such a way that it has optimal properties for efficient transmission through the waveguide 108. For instance, polarization or mode of the transmitted EM radiation may be controlled through a mode converter. The frequency multiplier 110 may receive the EM radiation 118 transmitted by the source 102 and modify the frequency of that EM radiation. The modified EM radiation 120 may then be transmitted or otherwise emitted from the frequency multiplier 110 toward the beam splitter 106. The beam splitter 106 may transmit the modified EM radiation 120 toward the detector 104, which may detect and register the modified EM radiation 120.

In addition to modifying the frequency response of the EM radiation 118, the frequency multiplier 110 and/or a separate modulator (not shown) may modulate the EM radiation 118 to encode it with digital and/or analog information. The frequency multiplier 110 may be used to modulate the signal, for instance, when it comprises an active frequency multiplier. In contrast, the separate modulator may be used when the frequency multiplier 110 comprises a passive frequency multiplier.

Modulation with the frequency multiplier 110 may comprise selectively supplying a voltage to the multiplier 110 to engage the frequency multiplication functionality. While the voltage is supplied and the frequency multiplication functionality is engaged, the multiplier 110 may modify the frequency of the EM radiation 118 received at the multiplier 110. In contrast, while the voltage is not supplied and the frequency multiplication functionality is not engaged, the multiplier may, for instance, reflect the EM radiation 118 back into the waveguide 108 without modifying the frequency. By switching the supply voltage on and off, the frequency multiplier 110 may modulate the EM radiation with high-frequency pulses or signals that are transmitted toward and received by the detector 104. The high-frequency pulses or signals may comprise binary digital signals that contain data and information from the downhole measurement and logging tools, and the detector 104 may include demodulation functionality or may transmit the received signals to a separate information handling system that may demodulate the signals to determine the data and information from the downhole measurement and logging tools.

The modulation process may be controlled, for instance, by a telemetry controller 122 coupled to the frequency multiplier 110, a power source 124 coupled to the frequency multiplier 110, or any separate modulator that may be incorporated into the system 100. As used herein a controller may comprise an information handling system, or any other device that contains at least one processor configured to perform certain actions. Example processors include microprocessors, microcontrollers, digital signal processors (DSP), application specific integrated circuits (ASIC), field programmable gate arrays (FPGA), or any other digital or analog circuitry configured to interpret and/or execute program instructions and/or process data. With respect to performing modulation with the frequency multiplier 110, controller 122, for instance, may receive, store, and buffer data and information from downhole measurement and logging tools (not shown), digitize that data and information, and generate control signals to the power source 124 associated with the multiplier 110. These control signals may be directed to one or more switches within the power source 124 or other power electronics and cause the switches to selectively open and close and supply a voltage to the multiplier 110 in the pattern and duration necessary to modulate the EM radiation with the digitized data. In other embodiments, one or more secondary controllers or information handling systems may be responsible for one or more of the data processing, digitization, and control signal generation steps. With respect to performing modulation with a separate modulator, the controller may output control signals directly to the modulator, or may, for instance, transmit the digitized information to the modulator, which may have a dedicated controller to modulate signals based on the digitized information.

As depicted, a filter 126 is coupled to the beam splitter 106 between the beam splitter 106 and the detector 104. The filter 126 may comprise, for instance, a band pass filter centered around the frequency of the modified EM radiation 120. In certain embodiments, the functionality provided by the filter 126 may be incorporated into the beam-splitter 106 and/or detector 104. For instance, the beam-splitter 106 may comprise a frequency dependent beam-splitter 106 that acts as a filter, or the detector 104 may comprise a narrowband detector which detects the higher frequency radiation 120 (coming from the frequency multiplier), but not radiation at the frequency of the source 102. The frequency of the modified EM radiation 120 may be determined using the frequency of the EM radiation 118 transmitted from the source and the multiplicative factor of the frequency multiplier 110, both of which may be fixed values known when the system 100 is assembled. When the filter 126 receives the EM radiation 120 from the beam splitter 106, it may also receive the EM radiation 118 transmitted from the source 102 as well as any signal and noise components introduced by the waveguide 108. The filter 126 may remove from the EM radiation any frequency components of the EM radiation outside of the relevant band. This may reduce any noise associated with the EM radiation, and improve the ability of the detector 104 to identify the high-frequency pulses generated by the frequency multiplier 110, for instance.

Although not depicted, the system 100 may further include an EM radiation detector located within the borehole 112 proximate the frequency multiplier 110. The downhole EM radiation detector may be used, for instance, to communicate information or commands downhole to the measurement and logging tools or other tools located downhole. The EM radiation generated by the source 102 may be modulated to contain digital data by cycling the source 102 on and off to generate the EM radiation in the necessary pulses and patterns. Alternatively, a separate modulator may be coupled between the source 102 and the beam splitter 106 to modulate the EM radiation 118 before it reaches the waveguide 108.

As depicted, the EM radiation detector 104 receives a single input signal from the beam splitter 106 comprising modified EM radiation 120 that is emitted from the frequency multiplier 110. The system 100, however, is not limited to detectors with the depicted configuration. Instead, detectors that receive more than one signal, such as coherent and heterodyne detectors, may be used. As will be described below, coherent and heterodyne detectors may be characterized by the use of a reference signal that may be compared against the input signal to improve detection of signal modulations and pulses in the modified EM radiation 120.

Figure 2:
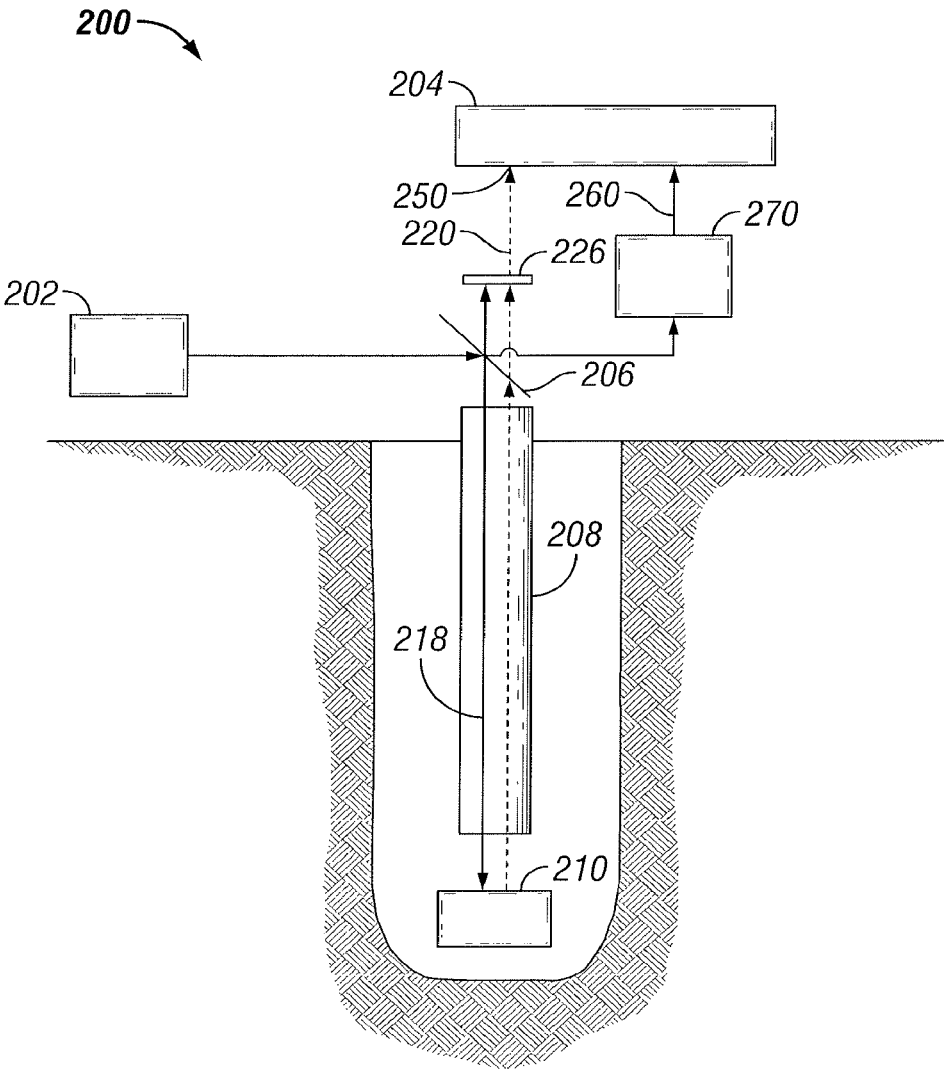
FIG. 2 is a diagram illustrating another example telemetry system, according to aspects of the present disclosure.

FIG. 2 is a diagram of an example telemetry system 200 incorporating a coherent detector 204, according to aspects of the present disclosure. As depicted, the coherent detector 204 is coupled to a beam splitter 206 through two different channels: a first channel 250 through which the coherent detector 204 may receive an input signal and a second channel 260 through which the coherent detector may receive a reference signal. The first channel 250 may comprise a direct connection between the detector 204 and the beam splitter 206 or an indirect connection through an intermediate filter 226. The second channel 250 may comprise, for instance, an indirect connection through a frequency multiplier 270 coupled between the detector 204 and the beam splitter 206.

The input signal received at the detector 204 through the first channel may be similar to the input signal described above with respect to FIG. 1. For instance, the input signal may comprise modified EM radiation 220 emitted by a frequency multiplier 210 after the frequency multiplier 210 receives EM radiation 218 from an EM radiation source 202. The EM radiation source 202 may transmit the EM radiation 218 to the frequency multiplier 210 through the beam splitter 206 and the waveguide 208, at which point the frequency multiplier 210 may modify the EM radiation 218 and emit or otherwise transmit the modified EM radiation 220 to the detector 204 through the waveguide 208 and the beam splitter 206.

As depicted, the reference signal received at the detector 204 may comprise EM radiation 218 transmitted from the source 202 that is received at and modified by the frequency multiplier 270. The frequency multiplier 270 may receive the EM radiation 218 transmitted from the source 202 at or before the beam splitter 206, so that the frequency multiplier 270 receives the radiation 218 in a form unmodified by the downhole frequency multiplier 210. The frequency multiplier 270 may then modify the frequency of the radiation 218 in substantially the same manner and magnitude in which the downhole frequency multiplier 210 modifies the radiation 218 that travels downhole through the waveguide 208. For instance, both the frequency multiplier 210 and the frequency multiplier 270 may double the frequency of the EM radiation 218 so that the input signal and the reference signal have substantially the same frequency when they reach the detector 204. Additionally, because the input signal and the reference signal are derived from the same radiation source 202, they will maintain coherence, meaning they will be in a fixed phase relationship. The coherent detector 204 may compare the input signal to the reference signal using the fixed-phase relationship to identify the high frequency pulses or signals within the modified EM radiation 220 emitted by the downhole frequency multiplier 210.

Figure 3:
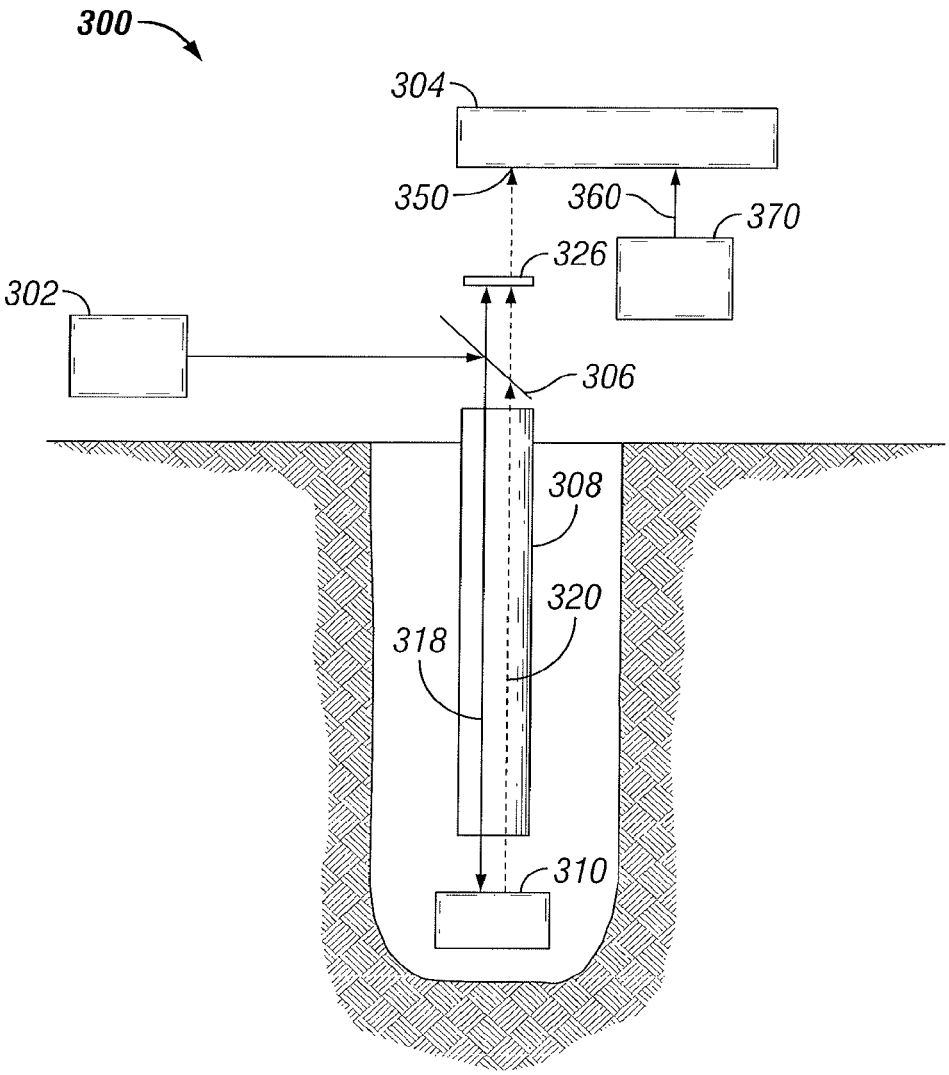
FIG. 3 is a diagram illustrating another example telemetry system, according to aspects of the present disclosure.

FIG. 3 is a diagram of an example telemetry system 300 incorporating a heterodyne detector 304, according to aspects of the present disclosure. Like the coherent detector described above, the heterodyne detector 304 may receive an input signal through a first channel 350 and a reference signal through a second channel 360. Unlike the coherent detector described above, however, the heterodyne detector 304 may receive the reference signal from a secondary EM radiation source 370 coupled directly to the detector 304.

In use, the primary EM radiation source 302 may transmit EM radiation 318 at a first frequency through a beam splitter 306 and waveguide 308 to a downhole frequency multiplier 310. The downhole frequency multiplier 310 may receive the radiation 318 and emit modified EM radiation 320 at a second frequency. The modified EM radiation 320 may be received as an input signal at the detector after traveling through the waveguide 308 and the beam splitter 306. The secondary EM radiation source 370 coupled to the detector 304 may produce a reference EM radiation signal at the second frequency. The heterodyne detector 304 may then detect the modified EM radiation 320 in the input signal by producing a beat signal between the modified EM radiation 320 and the reference EM radiation from the secondary source 370. This can be used to measure the power of the modified EM radiation 320 to identify any modulation in the modified EM radiation 320 that may contain downhole information.

Figure 4:
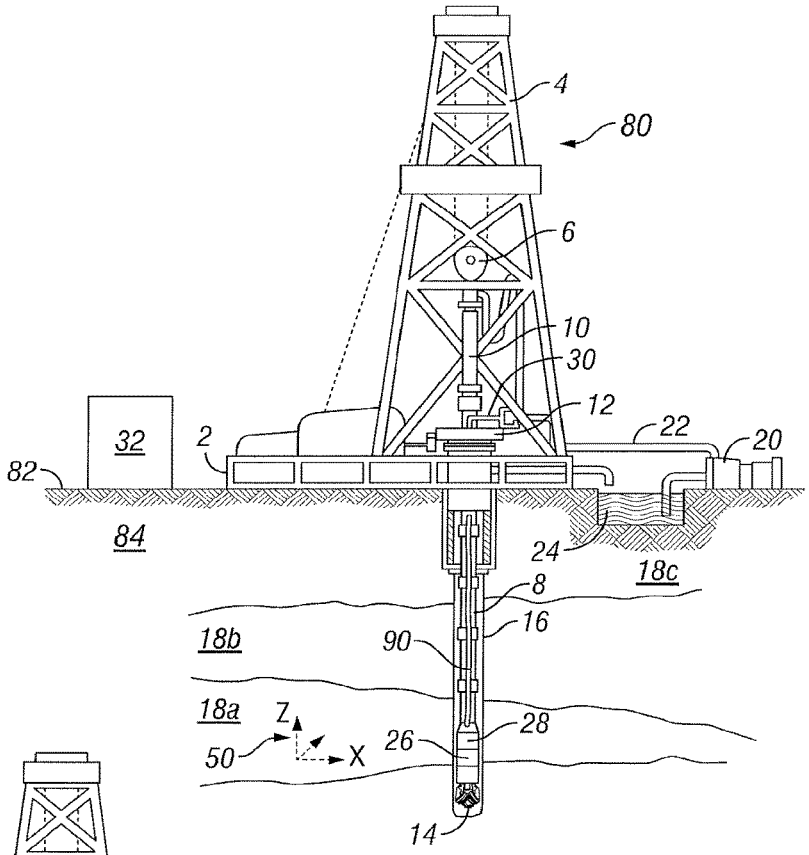
FIG. 4 is a diagram showing an illustrative drilling system, according to aspects of the present disclosure.

One or more of the systems, and/or methods described above may be incorporated into/with a wireline tool/sonde for wireline logging operation or into/with one or more LWD/MWD tools for drilling operations. FIG. 4 is a diagram showing a subterranean drilling system 80 incorporating aspects of the telemetry systems describe above. The drilling system 80 comprises a drilling platform 2 positioned at the surface 82. As depicted, the surface 82 comprises the top of a formation 84 containing one or more rock strata or layers 18*a-c*, and the drilling platform 2 may be in contact with the surface 82. In other embodiments, such as in an off-shore drilling operation, the surface 82 may be separated from the drilling platform 2 by a volume of water.

The drilling system 80 comprises a derrick 4 supported by the drilling platform 2 and having a traveling block 6 for raising and lowering a drill string 8. The drill string 8 comprises drill pipe segments to which a waveguide 90 is attached. As depicted, the waveguide 90 is coupled to an outer surface of the drill string 8, but other positions with respect to the drilling string 8 and pipe segments are possible within the scope of this disclosure. A kelly 10 may support the drill string 8 as it is lowered through a rotary table 12. A drill bit 14 may be coupled to the drill string 8 and driven by a downhole motor and/or rotation of the drill string 8 by the rotary table 12. As bit 14 rotates, it creates a borehole 16 that passes through one or more rock strata or layers 18. A pump 20 may circulate drilling fluid through a feed pipe 22 to kelly 10, downhole through the interior of drill string 8, through orifices in drill bit 14, back to the surface via the annulus around drill string 8, and into a retention pit 24. The drilling fluid transports cuttings from the borehole 16 into the pit 24 and aids in maintaining integrity or the borehole 16.

The drilling system 80 may comprise a bottom hole assembly (BHA) coupled to the drill string 8 near the drill bit 14. The BHA may comprise various downhole measurement tools and sensors and LWD and MWD elements 26. As the bit extends the borehole 16 through the formations 18, the tool 26 may collect measurements relating to borehole 16 and the formation 84. The tools and sensors of the BHA including the tool 26 may be communicably coupled to a downhole telemetry element 28, which may incorporate, for instance, a downhole frequency multiplier, a power source, and a controller to selectively couple the power source to the frequency multiplier. The downhole telemetry element 28 may be coupled to a surface telemetry element 30 through the waveguide 90. The surface telemetry element 30 may comprise, for instance, a EM radiation source, an EM radiation detector, and a beam splitter. The surface and downhole telemetry elements 28/30 may cooperate to transfer measurements from tool 26 to the surface and/or to receive commands from the surface.

In certain embodiments, the drilling system 80 may comprise a surface control unit 32 positioned at the surface 82. The surface control unit 32 may comprise an information handling system communicably coupled to the surface telemetry elements 30 and may receive measurements from the tool 26 and/or transmit commands to the tool 26 though the surface telemetry elements 30. The surface control unit 32 may also receive measurements from the tool 26 when the tool 26 is retrieved at the surface 82. As is described above, the surface control unit 32 may process some or all of the measurements from the tool 26 to determine certain parameters of downhole elements, including the borehole 16 and formation 84.

Figure 5:
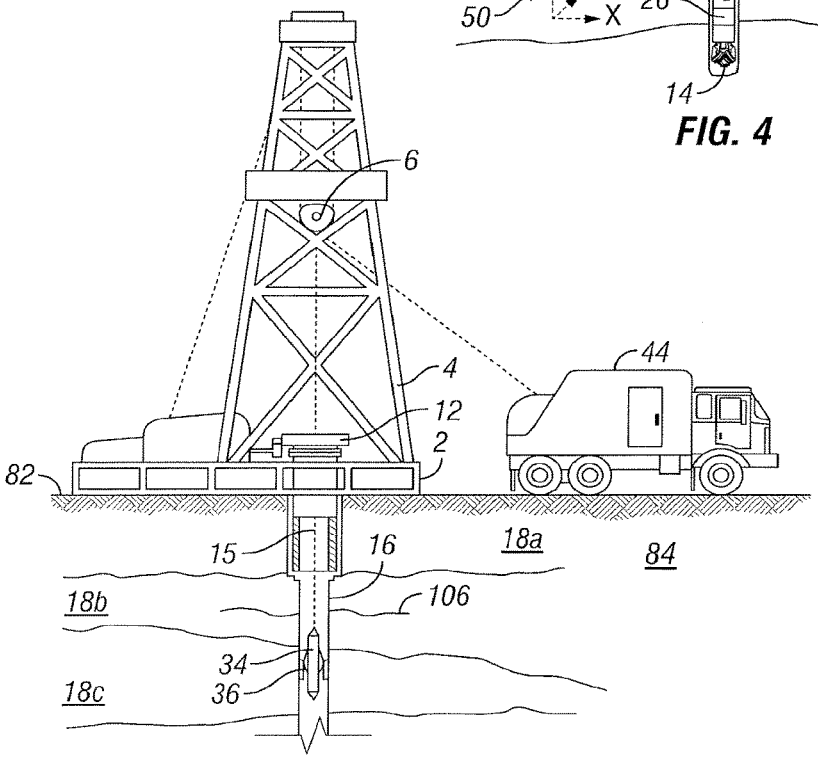
FIG. 5 is a diagram showing an illustrative wireline logging system, according to aspects of the present disclosure.

At various times during the drilling process, the drill string 8 may be removed from the borehole 16 as shown in FIG. 5. Once the drill string 8 has been removed, measurement/logging operations can be conducted using a wireline tool 34, e.g., an instrument that is suspended into the borehole 16 by a cable 15 having conductors for transporting power to the tool and telemetry from the tool body to the surface 82. The wireline tool 34 may comprise downhole logging and measurements tools as well as downhole telemetry elements 36 similar to those described above. The downhole telemetry elements 36 may be coupled to surface telemetry elements through a waveguide within the cable 15. A logging facility 44 (shown in FIG. 5 as a truck, although it may be any other structure) may include the surface telemetry elements and collect measurements from the downhole tools, and may include computing facilities (including, e.g., a control unit/information handling system) for controlling, processing, storing, and/or visualizing some or all of the measurements gathered.

According to aspects of the present disclosure, an example telemetry system for downhole operations in a subterranean formation comprises an electromagnetic (EM) radiation source and an EM radiation detector. The system may further include a waveguide coupled to the EM radiation source and the EM radiation detector. A frequency multiplier may be coupled to the waveguide and positioned within a borehole in the subterranean formation. In certain embodiments, the waveguide may comprise a metal pipe coupled to a drill string within the borehole. In certain embodiments, the waveguide may comprises an inner radius of about five or less millimeters. In certain embodiments, the frequency multiplier may comprise an active frequency multiplier that modifies a frequency of a received signal in response to an applied voltage. In certain embodiments, the system may further comprise a modulator coupled to the waveguide. In certain embodiments, the system may further comprise a band-pass filter coupled to the EM radiation detector. In certain embodiments, the system may further comprise an other EM radiation source coupled to the EM radiation detector, wherein the EM radiation detector comprises a heterodyne detector that receives an input signal from the frequency multiplier and receives a reference signal from the other EM radiation source; and the reference signal from the other EM radiation source has substantially the same frequency as the input signal received from the frequency multiplier through the beam splitter. In certain embodiments, the system may further comprise an other EM radiation detector coupled to the waveguide and positioned within the borehole In certain embodiments, the system may further comprise an other frequency multiplier coupled to the EM radiation source to receive EM radiation from the EM radiation source, wherein the EM radiation detector is coupled to and receives an output from the other frequency multiplier. The EM radiation detector may comprise a coherent detector that receives an input signal from the frequency multiplier and receives a reference signal from the other frequency multiplier.

According to aspects of the present disclosure, an example method may comprise transmitting electromagnetic (EM) radiation from an EM radiation source into a waveguide, and receiving and modifying a frequency of the transmitted EM radiation at a frequency multiplier coupled to the waveguide and positioned within a borehole in a subterranean formation. The modified EM radiation may be received at a EM radiation detector coupled to the waveguide. In certain embodiments, transmitting EM radiation from the EM radiation source into the waveguide may comprise transmitting EM radiation from the EM radiation source into a metal pipe coupled to a drill string within the borehole. In certain embodiments, the metal pipe may comprises a radius of about five or less millimeters. In certain embodiments, receiving and modifying the frequency of the transmitted EM radiation at the frequency multiplier coupled to the waveguide may comprise selectively applying a voltage to the frequency multiplier to modulate the transmitted EM radiation and encode information from at least one downhole tool. In certain embodiments, the method may further comprise modulating at least one of the modified EM radiation and the transmitted EM radiation with a modulator coupled to the waveguide. In certain embodiments, the method may further comprise filtering the modified EM radiation with a band-pass filter before receiving the modified EM radiation at the EM radiation detector. In certain embodiments, the method may further comprise providing an other EM radiation source coupled to the EM radiation detector, wherein the EM radiation detector comprises a heterodyne detector that receives the modified EM radiation from the frequency multiplier as an input signal and receives a reference signal from the other EM radiation source; and the reference signal from the other EM radiation source has substantially the same frequency as the input signal received from the frequency multiplier. In certain embodiments, the method may further comprise receiving the transmitted EM radiation at an other EM radiation detector coupled to the waveguide and positioned within the borehole.

In certain embodiments, the method may further comprise receiving the transmitted EM radiation from the EM radiation source at an other frequency multiplier, wherein the EM radiation detector is coupled to and receives an output from the other frequency multiplier. The EM radiation detector may comprise a coherent detector that receives the modified EM radiation from the frequency multiplier as an input signal and receives an output from the other frequency multiplier as a reference signal.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A telemetry system for downhole operations in a subterranean formation, comprising:

a high-frequency electromagnetic (EM) radiation source (EM radiation source), wherein the EM radiation source generates quasi-optical EM radiation;

an EM radiation detector coupled to a beam splitter via a first channel and a second channel;

a waveguide coupled to the EM radiation source and the EM radiation detector; and a first frequency multiplier coupled to the waveguide and positioned within a borehole in the subterranean formation, wherein the EM radiation detector is coupled to and receives a first output from the first frequency multiplier on a first channel; and a second frequency multiplier coupled to the EM radiation source to receive EM radiation from the EM radiation source at or before the beam splitter, wherein the EM radiation detector is coupled to and receives a second output from the second frequency multiplier on a second channel.

2. The telemetry system of claim 1, wherein the waveguide comprises a metal pipe coupled to a drill string within the borehole.

3. The telemetry system of claim 2, wherein the waveguide comprises an inner radius of about five or less millimeters.

4. The telemetry system of claim 1, wherein the first frequency multiplier comprises an active frequency multiplier that modifies a frequency of a received signal in response to an applied voltage.

5. The telemetry system of claim 1, further comprising a modulator coupled to the waveguide, wherein the first frequency multiplier is a passive frequency multiplier.

6. The telemetry system of claim 1, further comprising a band-pass filter coupled to the EM radiation detector.

7. The telemetry system of claim 1, wherein the EM radiation detector comprises a coherent detector that receives an input signal from the first frequency multiplier and receives a reference signal from the second frequency multiplier.

8. The telemetry system of claim 1, further comprising an other EM radiation source coupled to the EM radiation detector, wherein the EM radiation detector comprises a heterodyne detector that receives an input signal from the first frequency multiplier and receives a reference signal from the second EM radiation source; and the reference signal from the other EM radiation source has substantially the same frequency as the input signal received from the first frequency multiplier through the beam splitter.

9. The telemetry system of claim 1, wherein the EM radiation detector is positioned within the borehole.

10. A method, comprising:

transmitting electromagnetic (EM) radiation from a high-frequency EM radiation source (EM radiation source) into a waveguide, wherein the EM radiation is quasi-optical EM radiation;

receiving and modifying a frequency of the transmitted EM radiation at a frequency multiplier coupled to the waveguide and positioned within a borehole in a subterranean formation;

receiving the modified EM radiation at a first channel of a EM radiation detector coupled to a beam splitter coupled to the waveguide.

11. The method of claim 10, wherein transmitting EM radiation from the EM radiation source into the waveguide comprises transmitting EM radiation from the EM radiation source into a metal pipe coupled to a drill string within the borehole.

12. The method of claim 11, wherein the metal pipe comprises a radius of about five or less millimeters.

13. The method of claim 10, wherein receiving and modifying the frequency of the transmitted EM radiation at the frequency multiplier coupled to the waveguide comprises selectively applying a voltage to the frequency multiplier to modulate the transmitted EM radiation and encode information from at least one downhole tool.

14. The method of claim 10, further comprising modulating at least one of the modified EM radiation and the transmitted EM radiation with a modulator coupled to the waveguide, wherein the frequency multiplier is a passive frequency multiplier.

15. The method of claim 10, further comprising filtering the modified EM radiation with a band-pass filter before receiving the modified EM radiation at the EM radiation detector.

16. The method of claim 10, further comprising receiving the transmitted EM radiation from the EM radiation source at an other frequency multiplier, wherein the EM radiation detector is coupled to and receives an output from the other frequency multiplier at a second channel.

17. The method of claim 16, wherein the EM radiation detector comprises a coherent detector that receives the modified EM radiation from the frequency multiplier as an input signal and receives an output from the other frequency multiplier as a reference signal.

18. The method of claim 10, further comprising providing an other EM radiation source coupled to the EM radiation detector, wherein the EM radiation detector comprises a heterodyne detector that receives the modified EM radiation from the frequency multiplier as an input signal and receives a reference signal from the other EM radiation source; and the reference signal from the other EM radiation source has substantially the same frequency as the input signal received from the frequency multiplier.

19. The method of claim 10, further comprising receiving the transmitted EM radiation at an other EM radiation detector coupled to the waveguide and positioned within the borehole.

* * * * *